United States Patent [19]

Froment

[11] Patent Number: 4,905,739

[45] Date of Patent: Mar. 6, 1990

[54] DRAWING SYSTEM FOR CONTROLLING THE HEDDLE FRAMES OF WEAVING MECHANISMS OF THE NEGATIVE TYPE

[75] Inventor: Jean-Paul Froment, Doussard, France

[73] Assignee: S.A. Des Establissments Staubli, Faverges, France

[21] Appl. No.: 291,653

[22] Filed: Dec. 29, 1988

[30] Foreign Application Priority Data

Jan. 20, 1988 [FR] France ..... 88 00827

[51] Int. Cl.[4] ..... D03C 1/14

[52] U.S. Cl. ..... 139/84; 139/88; 139/89

[58] Field of Search ..... 139/89, 82, 83, 84, 139/87, 88

[56] References Cited

U.S. PATENT DOCUMENTS 4,687,029 8/1987 Takada ..... 139/89

FOREIGN PATENT DOCUMENTS 43845 5/1908 Switzerland ..... 139/89

21199 of 1906 United Kingdom ..... 139/89

*Primary Examiner*—Henry S. Jaudon

*Attorney, Agent, or Firm*—Dowell & Dowell

[57] ABSTRACT

This invention relates to a drawing system for controlling the heddle frames of weaving mechanisms of the negative type, wherein the connection between each oscillating lever and the cable of the weaving mechanism and the return spring register which corresponds thereto is ensured by a secondary cable which winds on a part of the lever concentric to the pivot axis thereof, in order to ensure for the register a perfectly linear displacement.

2 Claims, 4 Drawing Sheets

DRAWING SYSTEM FOR CONTROLLING THE HEDDLE FRAMES OF WEAVING MECHANISMS OF THE NEGATIVE TYPE

FIELD OF THE INVENTION

The present invention relates to dobbies and other weaving mechanisms of the negative type for forming the shed in weaving machines, and more particularly to the drawing systems adapted to control the heddle frames associated with such mechanisms.

BACKGROUND OF THE INVENTION

It is known that mechanisms of the negative type ensure positive control of the heddle frames only in one direction of the stroke thereof, with the result that resilient members must be provided, arranged so as to effect the return of the frames to the other end of the stroke.

In fact, and as schematically shown in FIG. 1 of the accompanying drawings, the resilient members associated with each heddle frame are most often constituted by two series or "registers" of parallel springs 1; in each register, the springs are retained between a rack 2 fixed to the structure 3 of the weaving machine and a clip element 4 articulated at 5 on an oscillating lever 6, which is carried by a horizontal pin or pivot 7 secured to the structure 3. On each of the two oscillating levers 6 associated with the same heddle frame 8 is joined, opposite the point of coupling 5 of the clip element 4 with respect to the pin 7, a maneuvring cable 10 which is fixed laterally to the frame 8 to be controlled and whose free end, suitably guided, is hooked to corresponding mobile member of the weaving mechanism.

It will be readily understood that such a drawing system ensures control of the heddle frame 8 since the displacement of the the mobile member provokes lowering of the frame to its low position against the springs 1, after which the springs return the heddle frame to an elevated position by acting on each lever 6 as soon as the mobile member of the mechanism returns to its initial position.

This conventional system is entirely satisfactory as long as the operational speeds remain relatively moderate. On the other hand, it becomes less so for the high speeds which are at present demanded of weaving machines. In fact, the point of coupling 5 moves in an arc of circle concentric to pin 7, so that, during operation, the clip element 4 undergoes the transverse deviation of positioning referenced d. Such continual reciprocating displacement imparts vibrations which are detrimental to the operation of the assembly of the two series or "registers" of springs 1.

SUMMARY OF THE INVENTION

It is a principal object of the present invention to overcome the aforementioned drawback, essentially by ensuring the connection between each of the oscillating levers and the fastening of each spring register is accomplished with the aid of a flexible member in the form of cable which winds on a part of the lever which is substantially concentric to the pivot axis thereof.

BRIEF DESCRIPTION OF THE DRAWINGS

The invention will be more readily understood on reading the following description with reference to the accompanying drawings, in which.

DETAILED DESCRIPTION OF THE DRAWINGS

Figure 1:
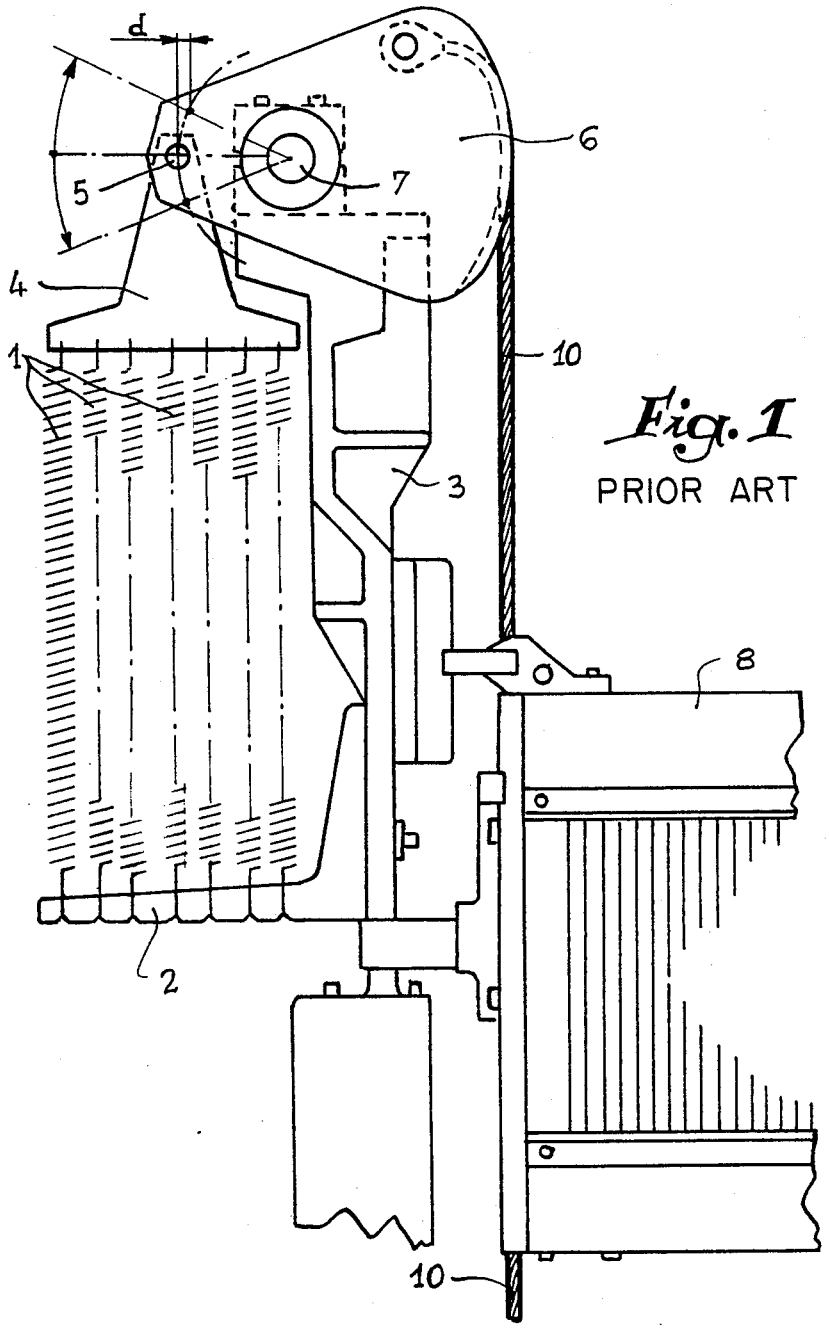
Fig. 1 PRIOR ART
FIG. 1, as indicated hereinabove, schematically shows in elevation the arrangement of a conventional drawing system.
Figure 2:
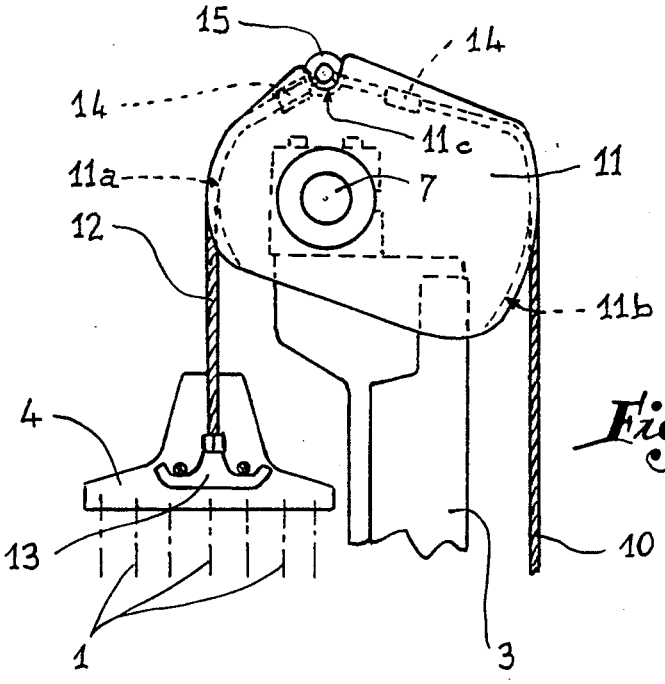
FIG. 2 illustrates in the same manner the arrangement of a system according to the invention.

Referring again to the drawings, FIG. 2 shows the principal cable 10 again, but it is fixed on an oscillating lever 11 of particular type, which is connected to the clip element 4 of the corresponding spring register 1 by a flexible member in the form of cable 12.

Figure 3:
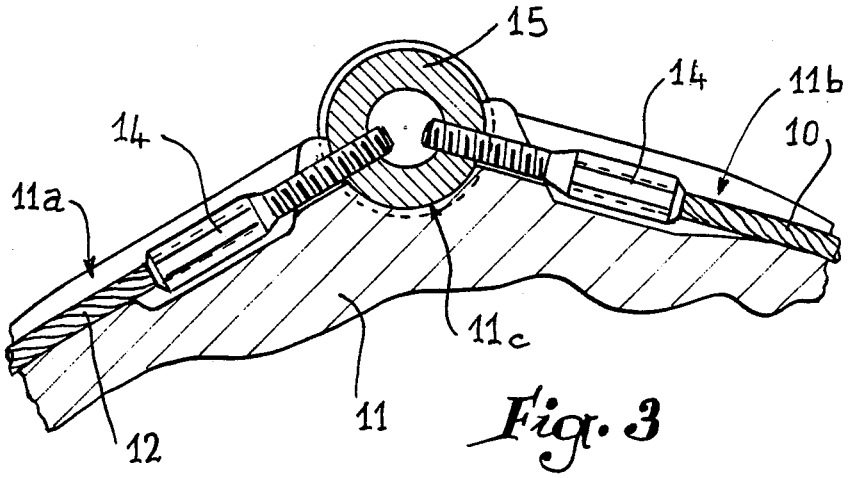
FIG. 3 is a vertical section, on a larger scale, showing the mode of fastening the two opposite cables on one of the pivoting levers.

As shown more particularly in FIG. 3, this secondary cable 12 winds in a groove 11*a* made in the periphery of the lever 11 concentrically to the pivot pin 7. One of the ends of this cable 12 is secured to a stirrup element 13 (FIG. 2) suitably retained on the clip element 4, while the opposite end comprises an endpiece 14 (FIG. 3) housed in the groove 11*a* and provided with a threaded rod which is screwed in a radial tapping in a cylindrical core 15. The core receives in the same manner an identical endpiece 14 housed in the opposite groove 11*b* of the lever 11 which ensures guiding of the principal cable 10, as the second endpiece 14 is fixed to the end thereof. The core 15, suitably shouldered laterally, is thus capable of engaging in a semi-cylindrical cradle 11*c* made in the periphery of the lever 11, between the adjacent ends of the grooves 11*a* and 11*b*.

It will be readily appreciated that, due to the flexibility of the two secondary cables 12 of the drawing system associated with each heddle frame 8, and the winding of these cables 12 in a groove 11*a* concentric to the pivot pin 7 of the levers 11, each clip element 4 and the springs 1 which are hooked thereon are animated by a perfectly linear reciprocating vertical displacement, without any transverse component likely to generate parasitic oscillations, whatever the speed of this reciprocating displacement.

It should be observed that the equilibrium of the efforts of traction which are exerted on the core 15 allows the core to be retained in place in its cradle 11*c* without any need for any fixing member. The construction and assembly are thus considerably simplified.

Figure 4:
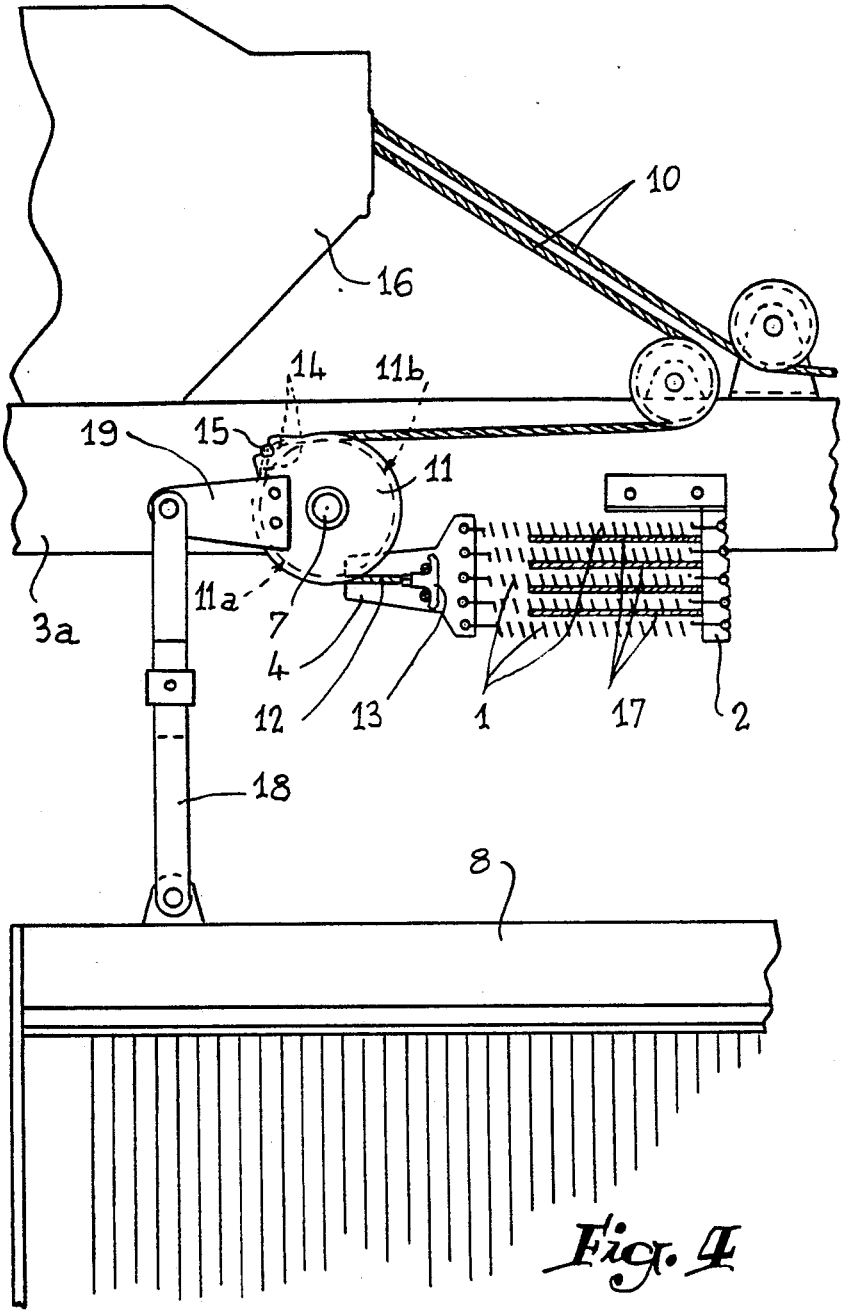
FIG. 4 illustrates another embodiment of the invention.

The elimination of the parasitic oscillations of the whole of the register and of the vibrations at high speed is such that the register may, without any drawback, be disposed horizontally, which could not be done up to the present time since the effect of gravity was added to the transverse vibrations mentioned above. FIG. 4 shows that each of the two principal cables 10 attached to the same mobile member of the mechanism 16 is guided in order to be fixed to a core 15 which receives, as in FIGS. 2 and 3, the end of a secondary cable 12 joined to the clip element 4 of the spring register 1 in question. This core 15 is retained on an oscillating lever 11, here assumed to be in the form of a pulley of substantially circular profile mounted idly on a pin 7 carried by the horizontal beam 3*a* which connects the vertical structures 3 of the weaving machine.

The rack 2 is itself fixed vertically on the beam 3*a* and the perfectly linear movement of the springs makes it possible to slide therebetween inserts 17 which may advantageously be in the form of plates. These elements 17 serve as guides and stabilizers and they avoid the springs coming into contact with one another, consequently contributing to extending their life duration. In the construction shown, it has been assumed that each lever or pulley 11 was connected to the heddle frame 8 to be controlled by an adjustable rod 18 associated with a crank pin 19 radially secured to the lever or pulley 11.

The horizontal orientation of the spring registers 1 allows the registers to be installed in that part of the weaving machine, the most often unencumbered, which surmounts the heddle frames 8. Such horizontal orientation is obtained because of the adoption of the secondary cables 12 and to their winding on a bearing surface of the levers 11 concentric to the axis of rotation 7 thereof, and because of the assembly of the inserts 17 between the springs 1.

Figure 5:
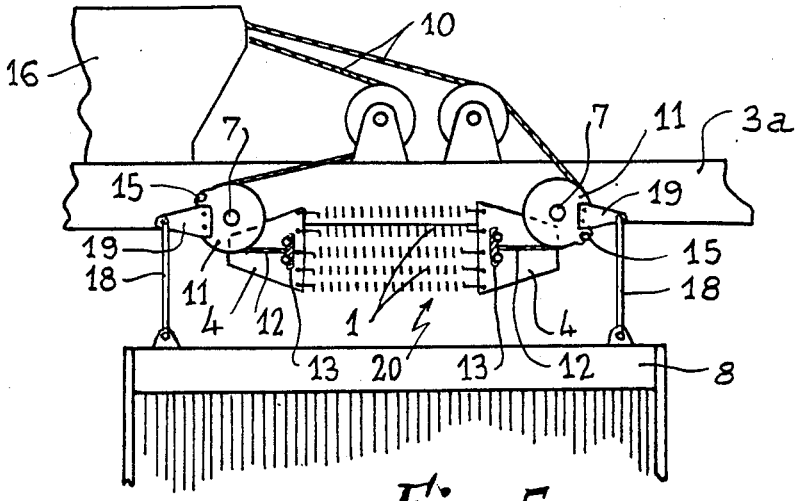
FIGS. 5 and 6 correspond to two variants.
Figure 6:
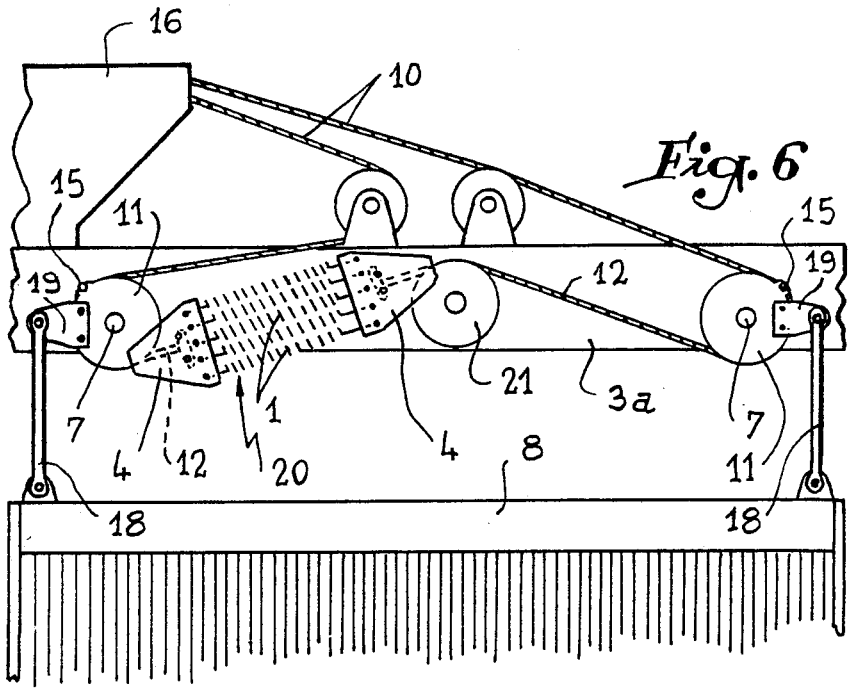

In addition, this same horizontal orientation makes it possible to ensure the resilient return of each heddle frame 8 with the aid of a single spring register, such as the one indicated at 20 in FIG. 5. In such a register 20, the springs 1, separated by inserts (not shown), are stretched between two clip elements 4 of which each forms a point of fastening for one or the other of the two secondary cables 12. In the embodiment of FIG. 6 where the frame 8 presents a greater length, one of the cables 12, which is longer than the other, cooperates with an intermediate guide pulley referenced 21.

It must, moreover, be understood that the foregoing description has been given only by way of example and that it in no way limits the domain of the invention which would not be exceeded by replacing the details of execution described by any other equivalents.

What is claimed is:

1. In an apparatus for controlling the movement of a heddle frame in a weaving machine wherein the heddle drive mechanism includes a mobile member which is connected by way of a pair of primary cables to each of a pair of oscillating lever means each of which is pivotable about a pivot axis and each of which is also connected to the heddle frame and wherein at least one spring means is connected to each of the lever means and wherein each of the primary cable means extends outwardly from a first peripherial portion of the lever means the improvement comprising, a secondary cable means extending outwardly from a second peripherial portion of each of said lever means, said spring means being connected to said secondary cable means, each of said second peripherial portions of said lever means being generally arcuate and substantially concentric with respect to the pivot axis of said lever means, a cradle formed in each of said lever means intermediate said first and second peripherial portions thereof, a core means selectively seated within each of said cradles and having generally opposite sides, each of said secondary cable means being connected to one of said opposite sides of said core means so that said secondary cable means winds upon said second peripherial portion of said lever means so that such winding is concentric to the pivot axis of said lever means, and each of said primary cable means being connected to said core means so as to extend outwardly from the other of said opposite sides of said core means whereby the tension created along the length of said primary and secondary cable means assists in retaining said core means within said cradles.

2. The apparatus of claim 1 in which said core means is substantially cylindrical in configuration and each of said primary and secondary cable means is provided with an end piece which is screwed radially into said generally opposite sides of said core means.

* * * * *